US005317254A

United States Patent [19]

Olson

[11] Patent Number: 5,317,254

[45] Date of Patent: May 31, 1994

[54] BIPOLAR POWER SUPPLY

[75] Inventor: Donald R. Olson, Shoreview, Minn.

[73] Assignee: Micro Control Company, Minneapolis, Minn.

[21] Appl. No.: 946,545

[22] Filed: Sep. 17, 1992

[51] Int. Cl.[5] ..... G05F 3/24

[52] U.S. Cl. ..... 323/316; 363/63; 307/261; 330/265

[58] Field of Search ..... 363/63; 323/316, 271, 323/269, 272, 273; 307/313, 491, 288, 315, 261; 330/263, 265

[56] References Cited

U.S. PATENT DOCUMENTS

| | | | |
|---|---|---|---|
| 3,704,381 | 11/1972 | Nercessian | 307/53 |
| 3,764,885 | 10/1973 | Buxbaum et al. | 363/63 |
| 3,792,365 | 2/1974 | Ellbogen | 330/15 |
| 4,042,875 | 8/1977 | Coulmance et al. | 323/271 |
| 4,395,675 | 7/1983 | Toumani | 323/271 |
| 4,458,200 | 7/1984 | Geller | 323/316 |
| 4,471,289 | 9/1984 | Duley et al. | 363/63 |
| 4,494,182 | 1/1985 | Brackman, Jr. | 363/63 |
| 4,613,810 | 9/1986 | Jablonski et al. | 323/271 |
| 4,667,144 | 5/1987 | Jones et al. | 323/271 |
| 4,792,885 | 12/1988 | Cuman et al. | 363/16 |
| 4,989,127 | 1/1991 | Wegener | 363/16 |
| 5,021,730 | 6/1991 | Smith | 363/63 |

OTHER PUBLICATIONS

*Operational Amplifiers Design and Applications*, Tobey, Graeme, Huelsman eds., p. 53, International Student Edition 1975.

*Primary Examiner*—R. Skudy
*Assistant Examiner*—Ben Davidson
*Attorney, Agent, or Firm*—Westman, Champlin & Kelly

[57] ABSTRACT

A bipolar power supply capable of selectably supplying either a positive or a negative voltage at an output terminal. The power supply comprises a first operational amplifier, a second operational amplifier, a first transistor electrically connected to a positive voltage source and a second transistor electrically connected to a negative voltage source. The first transistor is electrically connected to the first operational amplifier and the second transistor is electrically connected to the second operational amplifier so that the first and second amplifiers control the operation of the first and second transistors respectively. The inputs of the first and second operational amplifiers are electrically connected in a manner that prevents them from simultaneously providing large positive voltages at their outputs.

6 Claims, 1 Drawing Sheet

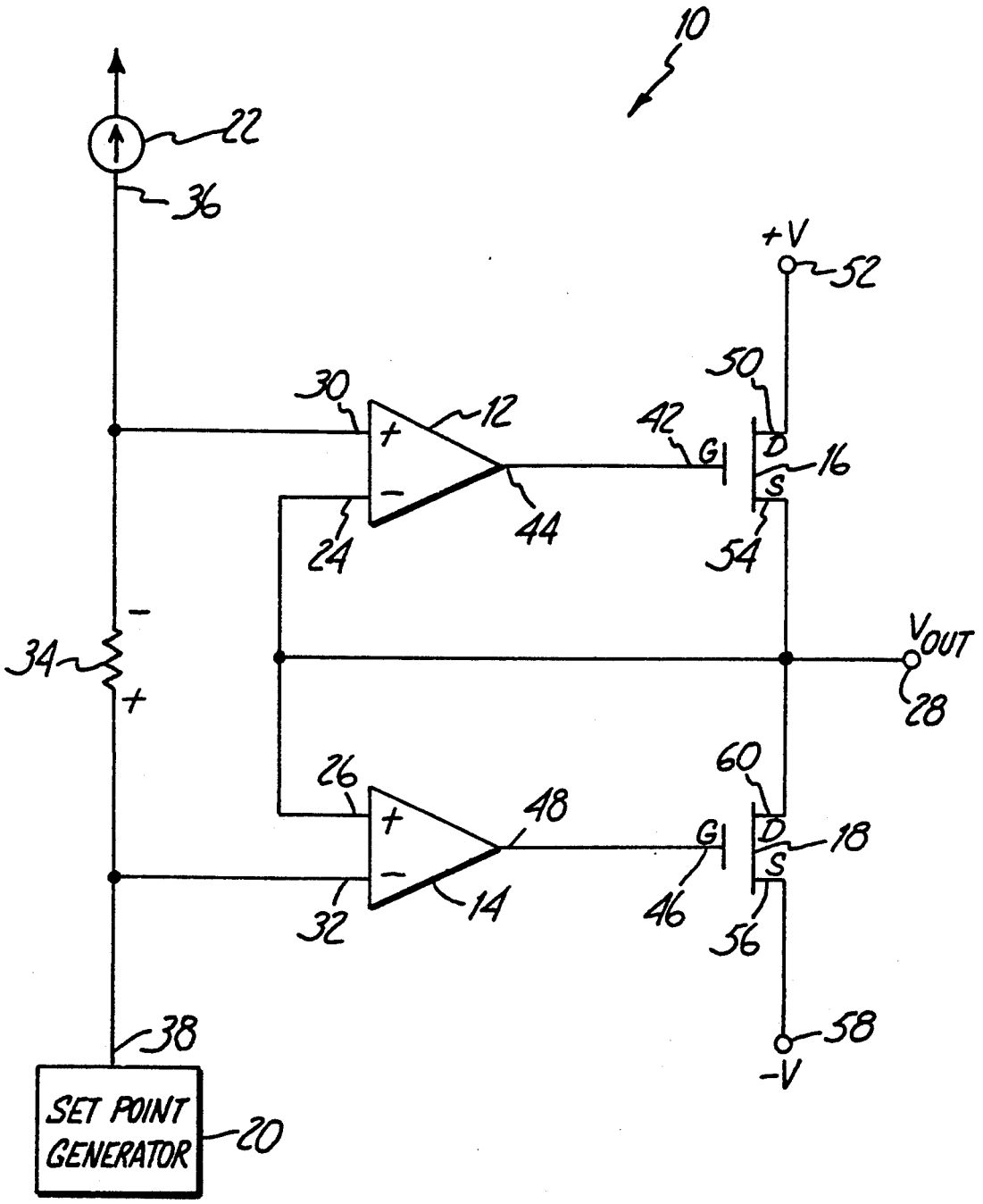
10
22
36
+V
52
50
30
12
42
G
D
16
S
44
24
54
34
VOUT
28
26
60
48
G
D
18
S
14
32
46
56
38
58
-V
SET POINT GENERATOR
20

BIPOLAR POWER SUPPLY

BACKGROUND OF THE INVENTION

The present invention relates to power supplies and, in particular, to a bipolar power supply capable of selectably supplying either a positive or a negative voltage at an output terminal.

In many electronic systems, it is desirable to be able to selectably provide a load with either a positive or a negative voltage. Such bipolar power supplies currently are fabricated in a variety of fashions. However, most have complicated designs and require the use of a large number of transistors, which occupy a large amount of space on the circuit board and are expensive to manufacture.

There is therefore the need for a bipolar power supply having a simple, inexpensive design that can effectively provide either a positive or a negative voltage at an output.

SUMMARY OF THE INVENTION

The present invention relates to a bipolar power supply for selectably providing either a positive or a negative voltage at an output terminal. The power supply comprises a first operational amplifier electrically connected to a first transistor and a second operational amplifier electrically connected to a second transistor.

A first input of the first amplifier is electrically connected to a first input of the second amplifier and a second input of the first amplifier is electrically connected to a second input of the second amplifier through a resistor. The first and second amplifiers are thus prevented from simultaneously providing large positive voltages at their outputs.

The first transistor is electrically connected to both a positive voltage source and the output terminal so that when turned on by the first amplifier, a positive voltage is provided at the output terminal. The second transistor is electrically connected to both a negative voltage source and the output terminal so that when turned on by the second amplifier, a negative voltage is provided at the output terminal.

A setpoint generator is electrically connected to both the first and second operational amplifiers. The setpoint generator can provide either a positive or a negative voltage to the first and second amplifiers, resulting in the provision of a positive voltage at an output of a selected one of the amplifiers and the provision of either a positive or a negative voltage at the output terminal.

BRIEF DESCRIPTION OF THE DRAWING

The sole figure is a schematic circuit diagram of the bipolar power supply of the present invention.

DETAILED DESCRIPTION OF THE PREFERRED EMBODIMENTS

A schematic of a bipolar power supply 10 of the present invention is shown in the figure. The power supply 10 comprises a first operational amplifier 12, a second operational amplifier 14, a first transistor 16 and a second transistor 18. A setpoint generator 20 and a current source 22 drive the first and second operational amplifiers 12,14.

An inverting input 24 of the first amplifier 12 is electrically connected to a noninverting input 26 of the second amplifier 14 and both inputs 24,26 are electrically connected to a power supply output terminal 28.

In this way, the same voltage will be applied to the inverting input 24 and the noninverting input 26. A noninverting input 30 of the first amplifier 12 is electrically connected to an inverting input 32 of the second amplifier 14 through a resistor 34. The resistor 34, which has a resistance of 240 ohms, causes a voltage drop between the noninverting input 30 and the inverting input 32.

An output 36 of the current source 22, which is electrically connected to the noninverting input 30 of the first amplifier 12 and is electrically connected to the inverting input 32 of the second amplifier 14 through the resistor 34, provides twenty microamperes of current. An output 38 of the setpoint generator 20 is electrically connected to the inverting input 32 of the second amplifier 14 and is electrically connected to the noninverting input 30 of the first amplifier 12 through the resistor 34.

The gate 42 of the first transistor 16 is electrically connected to an output 44 of the first amplifier 12 while the gate 46 of the second transistor 18 is electrically connected to an output 48 of the second amplifier 14. The drain 50 of the first transistor 16 is electrically connected to a positive voltage source 52 while the source 54 of the first transistor 16 is electrically connected to the output terminal 28. The source 56 of the second transistor 18 is electrically connected to a negative voltage source 58 while the drain 60 of the second transistor 18 is electrically connected to the output terminal 28.

The first transistor 16 and the second transistor 18 are both metal oxide semi-conductor field effect transistors (MOSFET). MOSFETs are used because they are inexpensive and do not require complicated drive circuitry, therefore allowing them to be driven by When the setpoint voltage is set at plus five volts, the voltage at the noninverting input 30 of the first amplifier 12 will be approximately five volts. If the voltage at the output terminal 28 is initially less than five volts, the voltage at the inverting input 24 of the first amplifier 12 will also be less than five volts, and the application of five volts at the noninverting input 30 will result in an output voltage approaching fifteen volts at the output 44 of the first amplifier 12. The output voltage is applied to the gate 42 of the first transistor 16 resulting in a positive voltage difference between the gate 42 and the source 54 ($V_{GS1}$) When this occurs, the first transistor 16 turns on allowing current to pass between the positive voltage source 52 and the output terminal 28 to provide a positive voltage at the output terminal 28.

The positive voltage source 52 provides a voltage of slightly greater than five volts to compensate for any losses between the voltage source 52 and the output terminal 28, permitting five volts to be provided at the output terminal 28. As the voltage at the output terminal 28 approaches five volts, the output voltage at the output 44 of the first amplifier 12 will substantially decrease. This results in a decrease in $V_{GS1}$ and a substantial shutting off of the current between the positive voltage source 52 and the output terminal 28.

When the setpoint voltage is plus five volts, the voltage at the inverting input 32 of the second amplifier 14 is five volts. If the voltage at the output terminal 28 (and therefore the noninverting terminal 26 of the second amplifier 14) is less than five volts, the second amplifier 14 provides a negative the operational amplifiers 12,14. In addition, the MOSFETs can handle currents of up to 30 to 40 amperes between the positive and negative voltage sources 52,58 and the output terminal 28.

The first operational amplifier 12 controls the operation of the first transistor 16, while the second operational amplifier 14 controls the operation of the second transistor 18. Upon the provision of a positive voltage at the output 44 of the first amplifier 12, the first transistor 16 will turn on, resulting in a source current between the positive voltage source 52 and the output terminal 28. Upon the provision of a positive voltage at the output 48 of the second amplifier 14, the second transistor 18 will turn on, resulting in a source current between the output terminal 28 and the negative voltage source 58.

In operation, the setpoint generator 20, which is typically a programmable digital-to-analog converter, provides a setpoint voltage of plus or minus five volts at its output 38. The positive and negative voltage sources 52,58 provide voltages of approximately plus and minus five volts, respectively. The voltage drop across the resistor 34 causes the voltage at the noninverting input 30 of the first amplifier 12 to be lower than that at the inverting input 32 of the second amplifier 14. This, along with the electrical connection of the inverting input 24 and the noninverting input 26, prevents the first and second amplifiers 12,14 from simultaneously providing large positive voltages at their outputs 44,48, respectively. For a twenty microampere current source 22 and a 240 ohm resistor 34, the voltage drop across the resistor 34 will be 4.8 millivolts. voltage at its output 48 approaching minus fifteen volts. This voltage is provided to the gate 46 of the second transistor 18, resulting in a negative voltage between the gate 46 and the source 56 ($V_{GS2}$). The second transistor 18 remains off and no current passes between the output terminal 28 and the negative voltage source 58.

When the setpoint voltage is set a minus five volts, the voltage at the inverting input 32 of the second amplifier 14 will be minus five volts. If the voltage at the output terminal 28 is initially greater than minus five volts, the voltage at the noninverting input 26 of the second amplifier 14 will also be greater than minus five volts, and the application of minus five volts at the inverting input 32 will result in an output voltage approaching fifteen volts at the output 48 of the second amplifier 14. The output voltage is applied to the gate 46 of the second transistor 18 resulting in a positive $V_{GS2}$. When this occurs, the second transistor 18 turns on allowing current to pass between the negative voltage source 58 and the output terminal 28 to provide a negative voltage at the output terminal 28.

The negative voltage source 58 provides a voltage of slightly less than minus five volts to compensate for any losses between the voltage source 58 and the output terminal 28, permitting minus five volts to be provided at the output terminal 28. As the voltage at the output terminal 28 approaches minus five volts, the output voltage at the output 48 of the second amplifier 14 will substantially decrease. This results in a decrease in $V_{GS2}$ and a substantial shutting off of the current between the negative voltage source 58 and the output terminal 28.

When the setpoint voltage is minus five volts, the voltage at the noninverting input 30 of the first amplifier 12 is approximately minus five volts. If the voltage at the output terminal 28 (and therefore the inverting terminal 24 of the first amplifier 12) is greater than minus five volts, the first amplifier 12 provides a negative voltage at its output 44 approaching minus fifteen volts. This voltage is provided to the gate 42 of the first transistor 16, resulting in a negative $V_{GS1}$. The first transistor 16 remains off and no current passes between the positive voltage source 52 and the output terminal 28.

If the voltage at the output terminal 28 is initially greater than five volts, the application of a setpoint voltage of plus five volts will result in an output voltage at the output 48 of the second amplifier 14. The second transistor 18 will turn on, allowing current to pass between the output terminal 28 and the negative voltage source 58 to lower the voltage at the output terminal 28 to plus five volts. Likewise, if the voltage at the output terminal 28 is initially less than minus five volts, the application of a setpoint voltage of minus five volts will result in an output voltage at the output 44 of the first amplifier 12. The first transistor 16 will turn on, allowing current to pass between the positive voltage source 52 and the output terminal 28 to raise the voltage at the output terminal 28 to minus five volts.

Although the setpoint voltage is described as being selected between plus and minus five volts, the setpoint voltage may have a number of other values. In addition, the voltages provided at the positive and negative voltage sources 52,58 can vary. However, the values of the positive and negative setpoint voltages should be the approximately the same as the values chosen for the positive and negative voltage sources 52,58 respectively, compensated for any losses as described.

The values of the resistor 34 and current source 22 were described as being 240 ohms and 20 microamperes respectively. However, these values can vary provided that the voltage drop across the resistor 34 is greater than the input offset voltage of the first and second amplifiers 12,14.

Although the present invention has been described with reference to preferred embodiments, workers skilled in the art will recognize that changes may be made in form and detail without departing from the spirit and scope of the invention.

What is claimed is:

1. A bipolar power supply for selectably providing a voltage from one of a positive voltage source and a negative voltage source at an output terminal, the power supply comprising:

first operational amplifier means having a first input offset voltage, a first input, a second input electrically connecting to the output terminal, and an output providing a first control signal;

second operational amplifier means having a second input offset voltage, a first input electrically connected to the output terminal and the second input of the first operational amplifier means, a second input, and an output providing a second control signal;

voltage offset means electrically connected to both the first input of the first operational amplifier means and the second input of the second operational amplifier means for setting the first input of the first operational amplifier means apart from the second input of the second operational amplifier means by a voltage potential which is designed to prevent simultaneous presence of the first and second control signals, and which exceeds a sum of the first and second input offset voltages;

a first metal oxide semiconductor field effect transistor (MOSFET) electrically connected to the first operational amplifier means and turned on with presence of the first control signal, the positive voltage source and the output terminal;

a second metal oxide semiconductor field effect transistor (MOSFET) electrically connected to the second operational amplifier means and turned on with presence of the second control signal, the negative voltage source and the output terminal;

selector means having an output, for providing a signal to the first and second operational amplifier means to determine the voltage to be provided at the output terminal.

2. The apparatus of claim 1 wherein the selector means comprises a digital-to-analog converter having an output electrically connected to the first operational amplifier means and the voltage offset means.

3. The apparatus of claim 1 wherein the first input of the first operational amplifier means is a noninverting input and the second input of the first operational amplifier means is an inverting input.

4. The apparatus of claim 1 wherein the first input of the second operational amplifier means is a noninverting input and the second input of the second operational amplifier means is an inverting input.

5. The apparatus of claim 1 wherein the voltage offset means comprises:

a resistor having a resistance value; and a current source coupled to the resistor, the current source providing a current having a source value so a product of the source value and the resistance value exceed the sum of the first and second input offset voltages.

6. A bipolar sink/source power supply for selectively coupling one of a positive voltage source and a negative voltage source to an output terminal, the power supply comprising:

a first operational amplifier having a first input offset voltage, a non-inverting input, an inverting input electrically connected to the output terminal, and an output providing a first control signal;

a second operational amplifier having a second input offset voltage, a non-inverting input electrically connected tot he output terminal and to the inverting input of the first operational amplifier, the second operational amplifier having an inverting input, and an output providing a second control signal;

resistance means, for providing a resistance value, electrically connected between the non-inverting input of the first operational amplifier and the inverting input of the second operational amplifier;

current source means, coupled to the resistance means, for supplying a current to the resistance means, the current supplied by the current source means and the resistance value having a product which exceeds a sum of the first input offset voltage and the second input offset voltage so the non-inverting input of the first operational amplifier and the inverting input of the second operational amplifier are separated by a voltage potential which is designed to prevent simultaneous presence of the first and second control signals, and which exceeds the sum of the first and second input offset voltages;

a first metal oxide semiconductor field effect transistor (MOSFET) electrically connected to the first operational amplifier and turned on with presence of the first control signal, the positive voltage source and the output terminal;

a second metal oxide semiconductor field effect transistor (MOSFET) electrically connected to the second operational amplifier and turned on with presence of the second control signal, the negative voltage source and the output terminal; and selector means having an output, for providing a signal tot he first and second operational amplifiers to determine the voltage to be provided at the output terminal.

* * * * *

UNITED STATES PATENT AND TRADEMARK OFFICE

CERTIFICATE OF CORRECTION

PATENT NO. : 5,317,254
DATED : May 31, 1994
INVENTOR(S) : David R. Olson

It is certified that error appears in the above-indentified patent and that said Letters Patent is hereby corrected as shown below:

Column 6, line 3, cancel "tot he" and insert --to the--.

Column 6, line 36, cancel "tot he" and insert --to the--.

Signed and Sealed this

Eighteenth Day of October, 1994

*Attest:*

*Attesting Officer*

BRUCE LEHMAN

*Commissioner of Patents and Trademarks*